US005088634A

United States Patent [19]

MacLaren

[11] Patent Number: 5,088,634

[45] Date of Patent: Feb. 18, 1992

[54] MAILBAG SUPPORT HARNESS

[76] Inventor: Terrence R. MacLaren, 530 Singh Street, Kamloops, British Columbia, Canada, V2B 5C2

[21] Appl. No.: 601,846

[22] Filed: Oct. 23, 1990

[51] Int. Cl.[5] ..... A45F 5/00; A45F 3/00

[52] U.S. Cl. ..... 224/252; 224/224; 224/268; 224/269

[58] Field of Search ..... 224/224, 252, 268, 269, 224/902, 211, 212, 253, 262, 263

[56] References Cited

U.S. PATENT DOCUMENTS

| | | | |
|---|---|---|---|
| 306,863 | 10/1884 | Robinson | 224/211 |
| 892,991 | 7/1990 | Hepworth | 224/259 |
| 1,736,131 | 11/1929 | Reece et al. | 224/268 |
| 3,322,312 | 5/1967 | Mitchell | 224/211 |
| 4,037,763 | 7/1977 | Turchen | 224/211 |
| 4,828,152 | 5/1990 | Pepping | 224/200 |
| 4,988,024 | 1/1991 | Weber | 224/253 |

FOREIGN PATENT DOCUMENTS

| | | | |
|---|---|---|---|
| 772988 | 12/1967 | Canada | 224/262 |

*Primary Examiner*—Ernest G. Cusick
*Assistant Examiner*—David J. Walczak
*Attorney, Agent, or Firm*—Barrigar & Oyen

[57] ABSTRACT

A harness for supporting a mailbag at waist level proximate to the front of a lettercarrier's body. The harness supports the weight of the mailbag about the lettercarrier's center of gravity and facilitates more efficient sorting and delivery of the mail.

12 Claims, 3 Drawing Sheets

MAILBAG SUPPORT HARNESS

FIELD OF THE INVENTION

This application pertains to a harness for supporting a load to be carried at waist level close to the user's centre of gravity. More particularly, this application relates to a harness for supporting a mailbag at the front of a user's body to facilitate more efficient sorting and delivery of the mail.

BACKGROUND OF THE INVENTION

Designers of backpacks and the like have long recognized that the most efficient and comfortable manner of carrying a heavy load is to support a large portion of the load around the user's hips, close to their centre of gravity. However, the applicant believes that this principle has not been successfully applied to packs and harnesses for supporting a load, such as a mailbag, at the front or side of a user's body.

Mailbags used by lettercarriers typically have a shoulder strap for suspending the bag over the user's shoulders. Over time many lettercarriers develop neck and back strain from carrying heavy mailbags in this manner. This is particularly true of lettercarriers having a slight build.

Another problem which has arisen is that it is often awkward for a lettercarrier to sort letters and packages stowed within the mailbag while it is being carried. Typically a lettercarrier must use one hand or arm to balance the mailbag in a slung position over their shoulder while at the same time attempting to sort or dispense mail using their free hand.

Various belts and harnesses for supporting objects to be carried have been proposed in the past which enable the wearer to free both hands for some other activity. For example, U.S. Pat. No. 892,991, which issued to J. M. Hepworth on July 14, 1908, discloses a fruit picker's belt for supporting fruit baskets at waist level. This device employs a pair of shoulder straps for supporting the weight of the basket contents, thereby enabling the picker to use both hands to gather fruit.

U.S. Pat. No. 4,828,152, which issued to Pepping on May 9, 1989, discloses a fishing harness and rod belt for use in stand-up fishing of large salt water game fish. The harness is designed to support the butt end of a game fish rod thereby leaving the fisherman with both hands free to manipulate the rod and reel in the fish.

Neither of the harnesses disclosed in the above-noted references are suitable for supporting a conventional mailbag at waist level against the front of lettercarrier's body. The need has accordingly arisen for a mailbag support harness serving this function which substantially reduces neck, shoulder and back strain by supporting the load to be carried around the lettercarrier's hips close to their centre of gravity.

SUMMARY OF THE INVENTION

In accordance with the invention, there is provided a harness for supporting a load to be carried which includes an adjustable length waist belt, a pair of upright brackets rigidly mounted on generally opposed sides of the waist belt for suspending the load, and an adjustable support strap releasably connectable to the upright brackets and extending therebetween above the waist belt.

The waist belt preferably includes two separate, arcuate belt portions and a pair of adjustable front and rear fasteners to releasibly join the arcuate portions together.

Each mounting bracket has a hook portion for use in suspending the load at approximately waist level. Advantageously, each mounting bracket includes spaced-apart forward and rear support rods. The forward rods include the bracket hook portions. The adjustable support strap preferably extends generally horizontally between the rear support rods.

The adjustable support strap is constructed from resilient material and includes complimentary hook and loop-type fasteners for releasibly securing the strap to the upright brackets at the desired height and tension.

Each of the upright brackets preferably has an inverted U shape, with the upper portions of the front and rear support rods being integrally connected.

BRIEF DESCRIPTION OF THE DRAWINGS

In drawings which illustrate the preferred embodiment of the invention.

DETAILED DESCRIPTION OF THE PREFERRED EMBODIMENT

Figure 1:
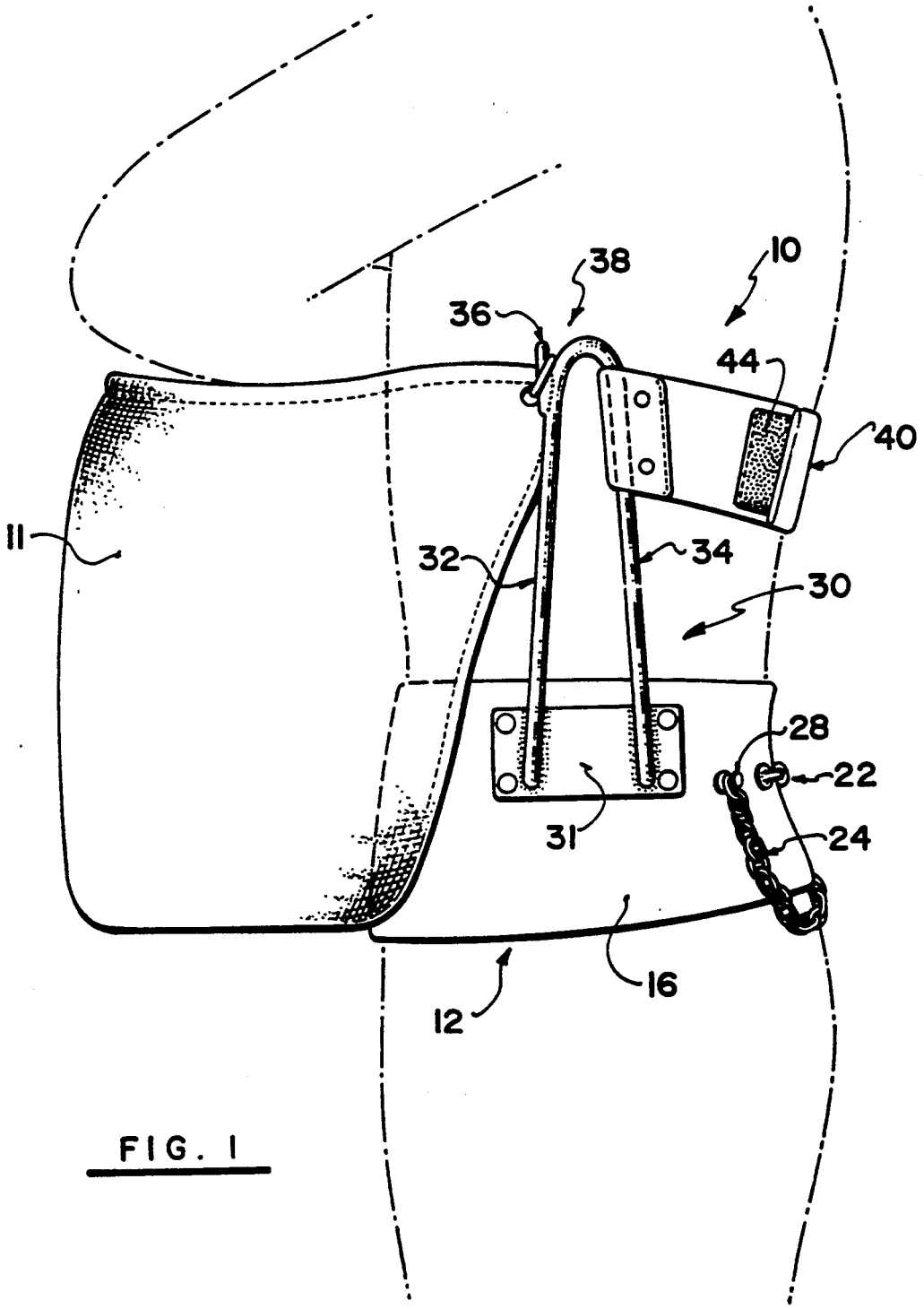
FIG. 1 is a side view of a lettercarrier (shown in phantom outline) wearing the support harness of the present invention to carry a conventional mailbag at waist level.

With reference to FIG. 1, the present invention is directed to a mailbag support harness generally designated 10 for supporting a conventional mailbag 11 against the front of a lettercarrier's body. Harness 10 supports mailbag 11 at approximately waist level close to the lettercarrier's centre of gravity and frees both of the lettercarrier's hands to enable efficient sorting and delivery of the mail.

Figure 2:
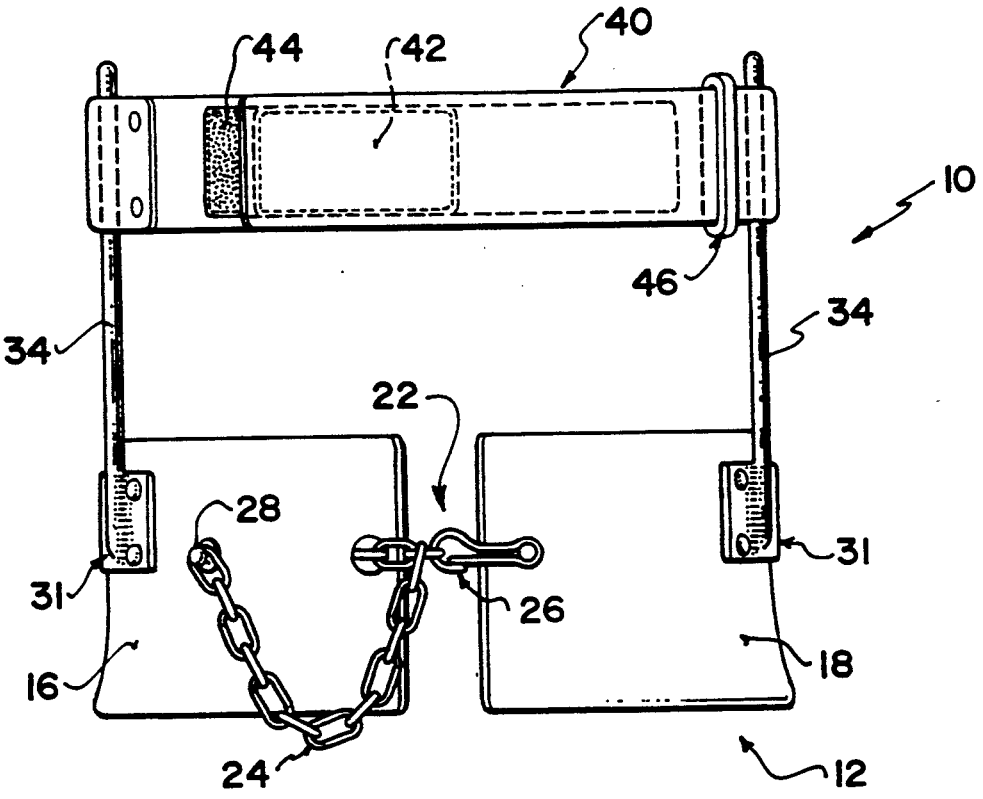
FIG. 2 is a rear view of the support harness of FIG. 1.
Figure 3:
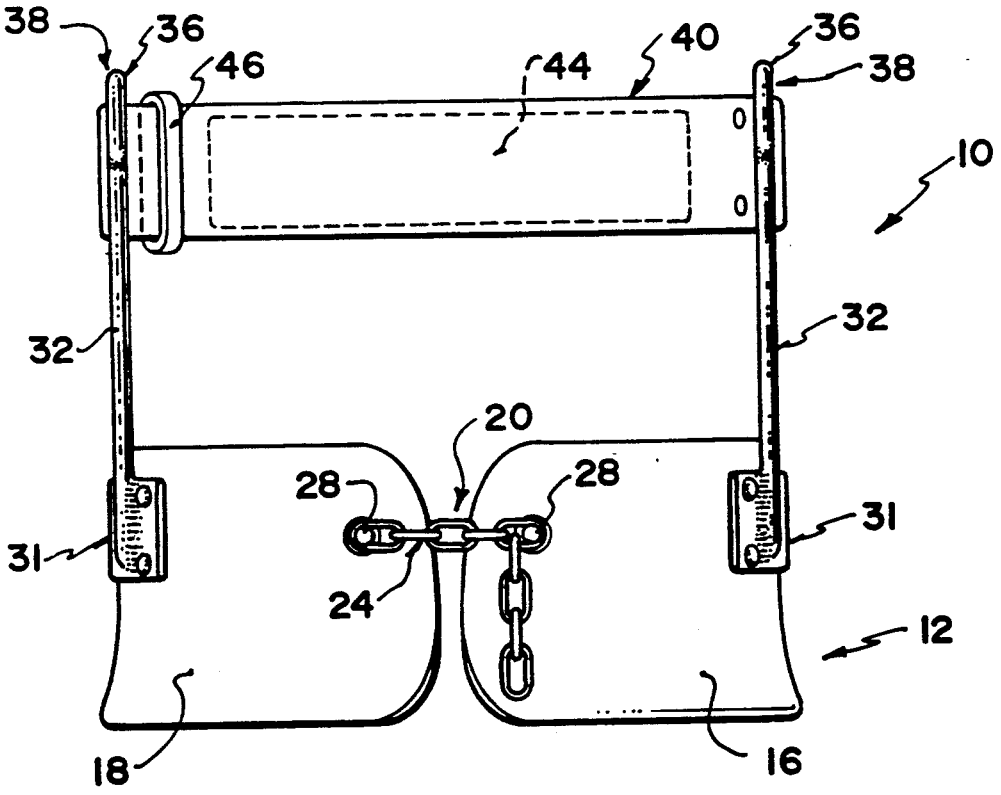
FIG. 3 is a front view of the support harness of FIG. 1.
Figure 4:
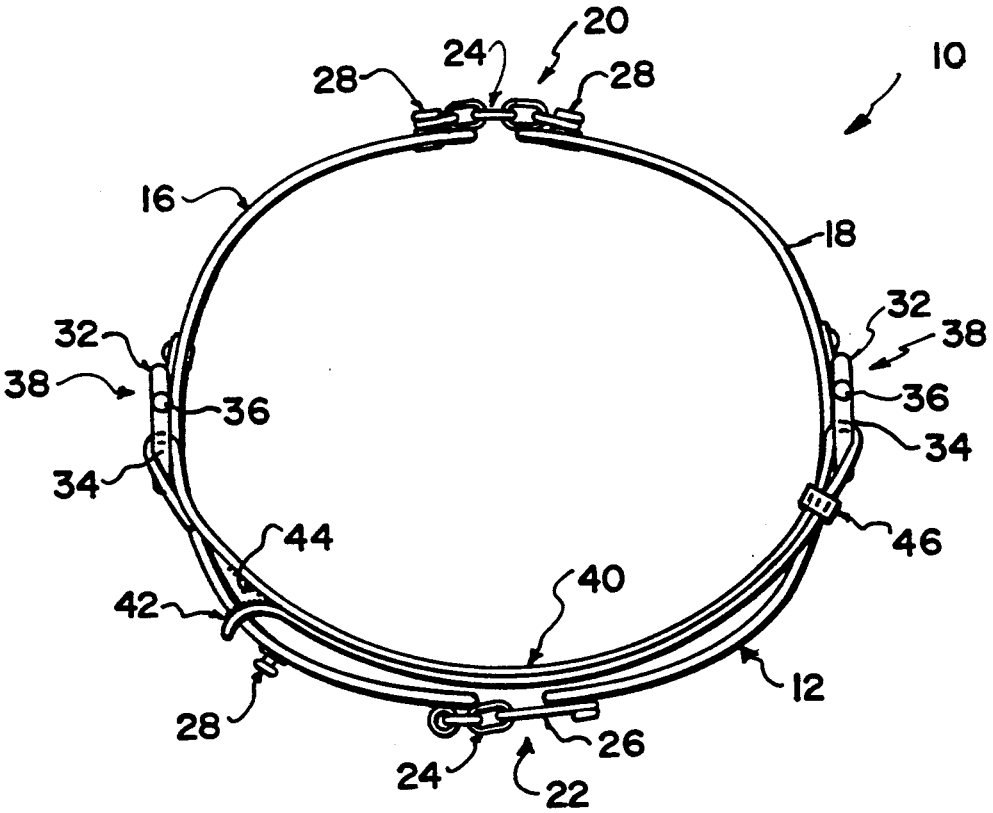
FIG. 4 is a top, plan view of the support harness of FIG. 1.

As shown in FIGS. 2 and 3, harness 10 includes a broad width belt 12 constructed from a pair of separate belt portions 16 and 18 which are curved to conform to the shape of the user's hips. Belt portions 16,18 are preferably constructed from a relatively stiff material, such as leather or plastic. The inner, concave surfaces of belt portions 16,18 may be padded for increased comfort.

Belt 12 is fastened around the lettercarrier's hips by securing a front fastener 20 and a rear fastener 22. Fasteners 20,22 are readily adjustable to conform to lettercarriers having different waist sizes and to accomodate for bulky winter parkas and the like. As shown in FIG. 2, rear fastener 22 may consist of a length of chain 24, which is secured to belt portion 16, and a clasp 26 which is secured to belt portion 18. Belt portions 16,18 may be releasibly joined together by fastening clasp 26 to one of the links of chain 24. The excess length of chain 24 may be suspended from a stud 28 secured to belt portion 16, as shown in FIGS. 1 and 2, so that it does not dangle between the user's legs.

As shown in FIG. 3, front fastener 20 may similarly consist of a length of chain 24 fastenable to a pair of studs 28 mounted on belt portions 16 and 18. As should be apparent to someone skilled in the art, fasteners 20,22 are described by way of illustration only and any other conventional fasteners could be substituted therefor to like effect.

A pair of rigid, upright support brackets 30 are mounted on opposed sides of waist belt 12. Each bracket 30 is preferably welded to a mounting plate 31 bolted or riveted directly to either belt portion 16 or 18. As shown best in Figure upright brackets 30 are generally U-shaped, comprising a forward post 32 and a rear post 34. A bar 36 extends outwardly from the upper portion of each forward post 32 to define a pair of hooks 38 for suspending mailbag 11. Most conventional mailbags 11 have a chain linkage which may be slung over hooks 38 as shown in FIG. 1.

Harness 10 also includes an adjustable back strap 40 which extends between rear posts 34 of support brackets 30. Back strap 40 is preferably constructed from a resilient material and is releasibly fastenable to rear posts 34 at a desired tension. For example, strap 40 may include a patch of hook-type VELCRO TM fastener 42 and a corresponding patch of loop-type VELCRO TM fastener 44. One end of strap 40 is secured to a rear post 34, as shown in FIGS. 1 and 2, and the other, free end of strap 40 having the hook-type VELCRO patch 42 is wound around the opposite rear post 34 and is threaded through a loop 46. The tension of back strap 40 is adjustable in a conventional manner by altering the degree of overlap of hook-type fastener 42 and loop-type fastener 44, as shown best in FIG. 2.

Back strap 40 is slidably adjustable on rear posts 34 so that it may be positioned at the optimum vertical position to suit the height and preferences of the user. The purpose of strap 40 is to maintain mailbag 11 in the proper orientation around the lettercarrier's hips and to assist in distributing the weight of mailbag 11 close to the lettercarrier's centre of gravity. In particular, back strap 40 counterbalances the weight of mailbag to prevent upright brackets 30 from tipping forwardly. Waist belt fasteners 20,22 may also be adjusted to ensure that support brackets 30 are maintained in a substantially vertical orientation.

In operation, harness 10 is initially adjusted by securing waist belt 12 around the lettercarrier's hips using fasteners 20,22. The position and tension of back strap 40 must also be initially adjusted to suit the lettercarrier's height and posture. It is imperative that back strap 40 be placed at a proper vertical position to guard against back strain and attendant injury to the user. Often it is necessary for the lettercarrier to test using harness 10 with strap 40 adjusted at different positions before the preferred setting is settled upon.

Rear belt fastener 22 and back strap 40 may be adjusted by the user before harness 10 is donned, or may alternatively be adjusted by an assistant with harness 10 postioned in the load carrying position shown in FIG. 1. Front belt fastener 20 is then secured to fasten belt 12 snugly around the user's hips and thereby maintain mounting brackets 30 in a substantially vertical orientation.

After harness 10 is adjusted as aforesaid, mailbag 11 is suspended from hooks 38 of bracket 30 as shown in FIG. 1. Mailbag 11 is thus maintained in the preferred load carrying position shown in FIG. 1 adjacent the front waist of the lettercarrier where it will not interfere with normal walking movements.

Mailbag 11 can be removed from harness 10 simply by lifting mailbag upwardly clear from hooks 38 of brackets 30.

While this invention has described with reference to mailbags, it should be apparent to someone skilled in the art that the support harness 10 disclosed herein may also be used to support analagous loads which must be accessible near the front of the user's body in the load carrying position. For example, harness 10 could be worn and used by delivery workers or paperboys in a similar manner.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A shoulder strap free harness to be worn by a user for supporting a load to be carried by a user, comprising:

(a) an adjustable length belt securely fastenable around the user's hips;

(b) a pair of upright brackets rigidly mounted on generally opposed sides of said belt and positionable alongside side portions of the user's body below shoulder level, said brackets comprising means for suspending said load snugly against a front portion of the user's body; and (c) an adjustable support strap extending between said brackets above said belt and positionable against a back portion of the user's body.

2. The harness as defined in claim 1, wherein said belt comprises:

(a) a pair of separate arcuate belt portions, each of said brackets being mounted on one of said belt portions; and (b) adjustable front and rear fasteners for releasably fastening said arcuate belt portions together to enable alignment of said brackets in a generally vertical orientation directly beneath the arm pits of the user.

3. The harness as defined in claim 2, wherein each of said brackets comprises a hook portion adapted for suspending the load at approximately the waist level of the user.

4. The harness as defined in claim 3, wherein each of said brackets comprises spaced-apart forward and rear support rods and wherein said forward rods include said hook portions.

5. The harness as defined in claim 4, wherein said support strap extends generally horizontally between said rear support rods.

6. The harness as defined in claim 5, wherein said support strap is slidably adjustable along a vertical axis of said rear support rods.

7. The harness as defined in claim 1, wherein said support strap further comprises complimentary hook and loop-type fasteners for releasably securing said support strap to said upright brackets at a desired tension.

8. The mailbag support harness as defined in claim 5, wherein said support strap further comprises complimentary hook and loop-type fasteners for releasably securing said support strap to said rear support rods at a desired tension.

9. The mailbag support harness as defined in claim 1, wherein said support strap is constructed from a resilient material.

10. The mailbag support harness as defined in claim 1, wherein each of said upright brackets has an inverted U shape.

11. The mailbag support harness as defined in claim 4, wherein the upper portions of said forward and rear support rods are integrally connected.

12. A shoulder strap free harness to be worn by a user for supporting a load to be carried by a user, comprising:

(a) an adjustable length belt securely fastenable around the user's hips, said belt comprising a pair of separate arcuate belt portions and front and rear fasteners for releasably fastening said belt portions together;

(b) a pair of upright, inverted U-shaped brackets rigidly mounted on generally opposed sides of said belt, each of said brackets being mounted on one of said separate belt portions and being positionable alongside side portions of the user's body in a generally vertical orientation directly beneath the arm pits of the user, each of said brackets comprising a hook portion adapted for suspending said load snugly against a front portion of the user's body at waist level; and (c) a support strap extending between said brackets above said belt and positionable against a back portion of the user's body, said support strap being slidably adjustable along a vertical axis of said brackets and including complementary hook and loop-type fasteners for releasably securing said support strap to said brackets at a desired tension.

* * * * *